United States Patent [19]

Leonardo

[11] 4,325,598

[45] Apr. 20, 1982

[54] GROUND CLAMP FOR GROUNDING COAXIAL CABLE

[75] Inventor: Ignazio Leonardo, Mountainside, N.J.

[73] Assignee: Diamond Communication Products, Inc., Garwood, N.J.

[21] Appl. No.: 105,965

[22] Filed: Dec. 21, 1979

[51] Int. Cl.[3] ..... H01R 4/66

[52] U.S. Cl. ..... 339/14 L; 339/95 R; 339/266 G

[58] Field of Search ..... 339/14 RF, 95 R, 95 D, 339/99 R, 13, 266 R, 265 R, 177 R; 174/78

[56] References Cited

U.S. PATENT DOCUMENTS

| | | | |
|---|---|---|---|
| 2,228,344 | 1/1941 | Demeo | 339/266 R X |
| 2,934,737 | 4/1960 | Gibson | 339/266 R X |
| 3,176,230 | 3/1965 | Collins | 174/88 C X |
| 3,428,938 | 2/1969 | Kulick | 339/266 R |
| 3,435,126 | 3/1969 | Hamilton | 174/78 |
| 3,594,682 | 7/1971 | Oleson | 339/95 R X |
| 3,753,204 | 8/1973 | Thompson | 174/78 X |
| 3,753,313 | 8/1973 | Frey | 174/78 X |
| 4,140,870 | 2/1979 | Volkers et al. | 339/14 L X |

FOREIGN PATENT DOCUMENTS

| | | | |
|---|---|---|---|
| 2741791 | 7/1978 | Fed. Rep. of Germany | 339/14 L |
| 269917 | 11/1950 | Switzerland | 339/266 R |

*Primary Examiner*—Eugene F. Desmond

*Attorney, Agent, or Firm*—Hopgood, Calimafde, Kalil, Blaustein & Judlowe

[57] ABSTRACT

The purpose of this invention is to provide a means for securing and grounding coaxial cable or a similar item. The design comprises a base plate and a grounding plate that incorporates a nest and penetrating prongs as an integral part and that includes a screw and two nuts and a lock washer. The design is unique in that one can provide a positive ground connection without the need for cutting, stripping or interrupting the continuity of the cable by merely pressing the cable into the nest of the grounding plate side of the clamp and sliding the base plate into position and tightening the clamping screw to lock the parts together. A ground wire is then placed under a second nut and tightened securely.

3 Claims, 6 Drawing Figures

GROUND CLAMP FOR GROUNDING COAXIAL CABLE

BACKGROUND AND SUMMARY OF INVENTION

This invention is used by merely pressing the cable into a ground plate nest at which time pointed prongs in the nest will penetrate or rupture the insulation and make contact with the outer shield of a cable and ground wire connected to a screw and nut which is used to connect the ground wire to the assembly.

The invention is also unique in that it is fabricated from sheet metal and incorporates pointed prongs of the nest as an integral part of the clamp. No inserts or loose parts can interfere with the electrical continuity of the circuit. This will affect both audio and visual reception through the CATV system. There is no interference or break in the co-ax cable assembly. It is foolproof with a continuous circuit.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
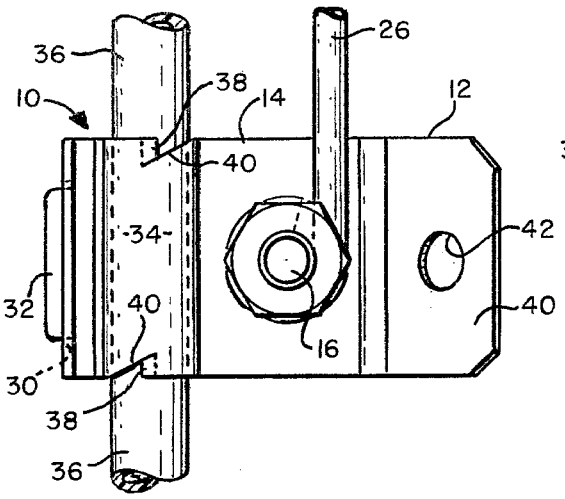
FIG. 1 is a top plan view of a grounding clamp made in accordance with this invention.
Figure 2:
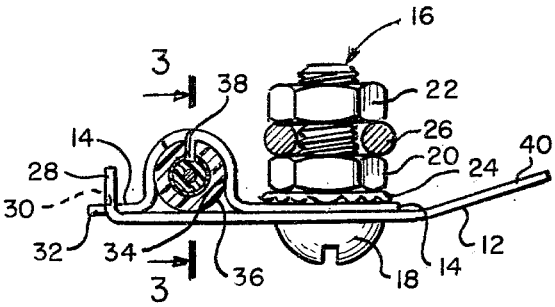
FIG. 2 is an elevation of the structure shown in FIG. 1 but with certain parts shown in section.

FIGS. 1 and 2 show the grounding clamp 10 of this invention. A base plate 12 and a grounding plate 14 are clamped together by a bolt 16. A head 18 of the bolt 16 bears against the underside of the base plate 12 and there are nuts 20 and 22 which screw over the threads of the bolt 16 above the grounding plate 14. The lower bolt 20 clamps a lock washer 24 against the grounding plate 14, and the upper nut 22 clamps a grounding wire 26 against the lower nut 20.

The ground wire 26 is bent around the stem of the bolt 16 and is of a diameter to be clamped between flat confronting surfaces of the nuts 20 and 22. This eliminates the necessity of a connector on the end of the ground wire which would fit over the bolt 16.

The base plate 12 has an upwardly extending end portion with a slot 30 through which an end tab 32 of the grounding plate extends. In some of the claims of this application, the base plate 12 is referred to as the "first plate" and the grounding plate 14 is referred to as the "second plate." The grounding plate 14 is constructed so that it has a nest 34 which fits snugly around a co-ax cable 36. The grounding clamp is designed for a particular size of cable 36 so that when the plates 12 and 14 are clamped together by the bolt 18, the cable 36 will be clamped snugly in the nest 34.

There are prongs 38 at opposite ends of the nest 34 and these prongs 38 are of the full thickness of the plates 12 and 14, but the tabs that are bent downwardly to form the prongs 38 come to a chisel point as will be evident from the notches 40 which are left in the side edges of the grounding plate 14 as clearly shown in FIG. 1. The clamp can accommodate other size cable by changing the size of the nest during manufacture.

The plates 12 and 14 are preferably both made of metal and stiff enough to firmly grip the cable 36 when the nuts 20 and 22 are screwed down tight to hold the plates 12 and 14 clamped together. The prongs 38 can be made to pierce the outer layer of insulation of the cable 36 by digital pressure when forcing the cable 36 into the nest 34.

The cable 36 has a center conductor 36*a* surrounded by insulation 36*b*. There is a grounding conductive layer 36*c* covered by an outer insulation 36*d*. As the prongs 38 rupture the outer insulation 36*d* they pierce the conductive layer 36*c*.

On the side of the nuts 20 and 22 remote from the nest 34, there is an angularly extending end of the base plate 12 and this angularly extending end portion, designated in FIGS. 1 and 2 by the reference character 40, has an opening 42 through which supports can extend for holding the grounding clamp in position along whatever structure the co-ax cable 36 is supported from.

Figure 3:
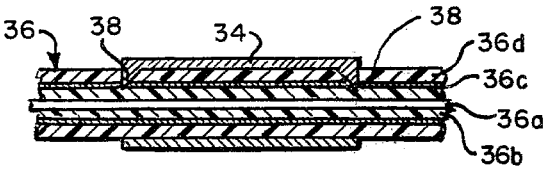
FIG. 3 is a sectional view taken on the lines 3—3 of FIG. 2.
Figure 4:
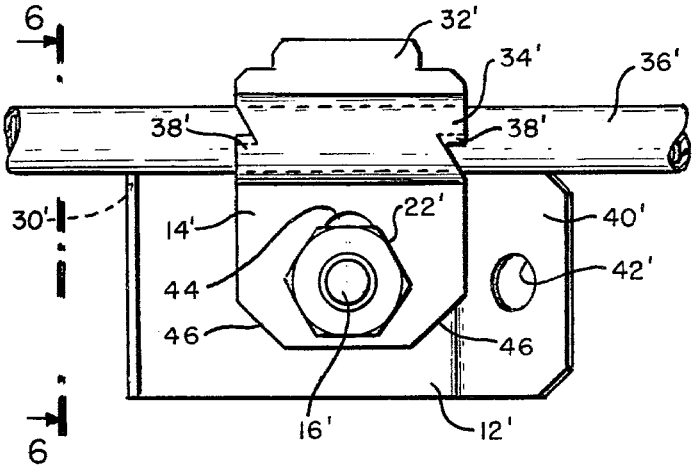
FIG. 4 is a modification of the construction shown in FIG. 1 and with the nest of the clamp in position to receive a coaxial cable.
Figure 5:
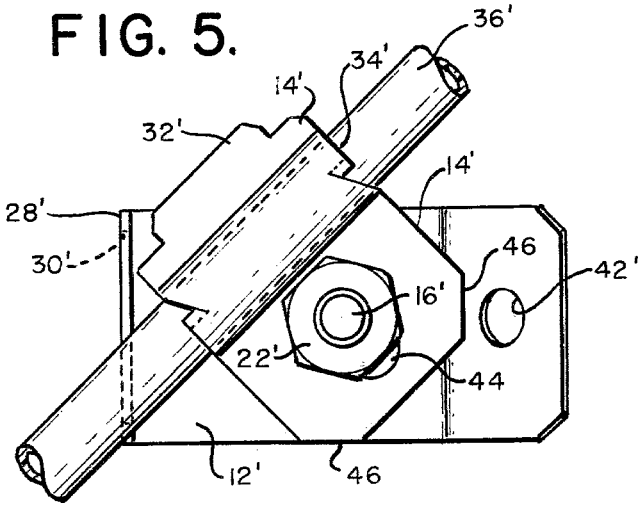
FIG. 5 is a view showing the parts of FIG. 4 in different positions so that the coaxial cable is held in the nest.
Figure 6:
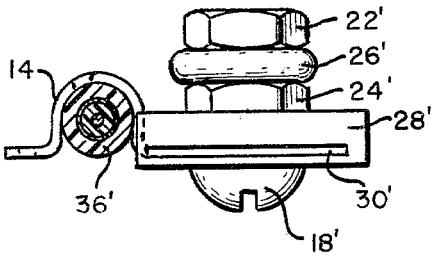
FIG. 6 is a sectional view taken on the lines 6—6 of FIG. 4.

FIGS. 4–6 show a modified form of the invention and corresponding parts are indicated by the same reference characters as in FIGS. 1–3 but with a prime appended. The principal difference between the grounding plate 14 and the grounding plate 14′ is that the latter has a slot 44 through which the bolt 16′ passes so that the grounding plate 14′ can be moved within a limited range with respect to the bolt 16′. The slot 44 is elongated in a direction which permits the nest 34′ to move toward and from the bolt 16′ so that the nest 34′ can be brought into a position just beyond the long sides of the base plate 12′. This permits the cable 36′ to be inserted into the nest 34′ without moving the plates 12′ and 14′ which can be moved into different positions with respect to one another so that the cable 36′ is held in the nest 34′ by the base plate 12′. Another modification in the grounding plate 14′ is that it has corners of the grounding plate 14′ cut away along diagonal edges 46 so that the grounding plate can be shifted into different positions by virtue of the slot 44, and the slot 30′ is preferably made longer so that the end portion 32′ does not have to always be parallel to the cable 36′. The cable 36′ cannot be clamped in position shown in FIG. 5. While the base plate 12′ will prevent the cable 36′ from coming out of the nest 34′ when the parts are in the position shown in FIG. 5, the plates 12′ and 14′ cannot be permanently clamped when in the position shown in FIG. 5 because the cable 36′ extends across the top of the vertically extending portion 28′ and cannot be clamped against the base plate 12′.

If the grounding plate 14′ and base plate 12′ are to be used for clamping the cable 36′ with a wider variety of angular positions than are possible with FIG. 5, then the vertically extending portion 28′ of the base plate 12′ can be turned downward instead of upward so that for any angular position of the cable 36′, the cable can be clamped against the base plate 12′ because it can contact the top surface of the base plate 12′ for almost any angular position of the nest 34′ and cable 36′; and the downwardly extending flange 28′ will still provide added stiffness for the base plate 12′.

The preferred embodiments of the invention have been illustrated and described, but changes and modifications can be made and some features can be used in different combinations without departing from the invention as defined in the claims.

What is claimed is:

1. A grounding clamp including in combination a generally rectangular first plate, a generally rectangular second plate, part of which has a flat surface that is adjacent to the first plate and another part that is shaped to form a nest for an electrical conductor, a bolt through adjacent flat portions of said plates for loosely and swingably retaining said plates and for clamping said plates together, said nest (a) in one angular relation of said plates confronting part of said first plate for clamped closure of said nest and (b) in another angular relation of said plates being exposed for reception of a conductor inserted therein, one or more inwardly directed prongs integrally formed from the nest and extending only substantially normal to and in the direction of the geometric plane of said flat surface and to an extent to contact with the periphery of a conductor located in the nest, an integrally formed upstanding lug along the edge of said first plate and remote from said bolt when said plates are in said one angular relation, said lug having a slot aperture therein, and said second plate at its edge remote from said bolt having a tab enterable into the slot aperture in the course of swing rotation of said plates from said second angular relation into said first angular relation.

2. The grounding clamp described in claim 1 characterized by said bolt means comprising a nut on a bolt for clamping the plates together under controlled pressure, and means for locking the nut in its adjusted clamping position.

3. The grounding clamp described in claim 2 characterized by the means for locking the nut in its adjusted position being a lock nut on the same bolt with the nut that clamps the plates together.

* * * * *